US006167875B1

(12) United States Patent
French et al.

(10) Patent No.: US 6,167,875 B1
(45) Date of Patent: Jan. 2, 2001

(54) MULTIPLE SPARK CAPACITIVE DISCHARGE IGNITION SYSTEM FOR AN INTERNAL COMBUSTION ENGINE

(75) Inventors: Michael J. French; Mark J. Skrzypchak, both of Kenosha, WI (US)

(73) Assignee: Outboard Marine Corporation, Waukegan, IL (US)

( * ) Notice: Under 35 U.S.C. 154(b), the term of this patent shall be extended for 0 days.

(21) Appl. No.: 09/201,363

(22) Filed: Nov. 30, 1998

Related U.S. Application Data

(63) Continuation of application No. PCT/US97/10206, filed on Jun. 19, 1997.
(60) Provisional application No. 60/020,033, filed on Jun. 21, 1996.

(51) Int. Cl.[7] ..... F02P 3/06
(52) U.S. Cl. ..... 123/606; 123/605

(58) Field of Search ..... 123/598, 605, 123/606, 637, 655, 656

(56) References Cited

U.S. PATENT DOCUMENTS 5,183,024 * 2/1993 Morita et al. ..... 123/598
5,429,103 * 7/1995 Rich ..... 123/598
5,471,362 * 11/1995 Gowan ..... 361/257

* cited by examiner

*Primary Examiner*—Noah P. Kamen
*Assistant Examiner*—Mahmoud M Gimie
(74) *Attorney, Agent, or Firm*—Fletcher, Yoker & Van Someren

(57) ABSTRACT

An ignition system for an internal combustion engine that generates more ignition sparks per ignition event, i.e., per cylinder, per cycle, when the engine is operated in the stratified fuel injected mode than when the engine is operated in the homogeneous fuel injection mode.

9 Claims, 8 Drawing Sheets

IGNITION–COIL–ON–TIME (ms)

| | y1 / x1 | 200 | 400 | 500 | 600 | 700 | 800 | 900 | 1000 | 1100 | 1200 | 1300 | 1400 | 1500 | 2000 | 2500 | 3000 | 3500 | 4000 | 4500 | 5000 | 5500 | 7000 |
|---|---|---|---|---|---|---|---|---|---|---|---|---|---|---|---|---|---|---|---|---|---|---|---|
| T | 0 | 5.0 | 5.0 | 4.0 | 3.0 | 3.0 | 3.0 | 3.0 | 3.0 | 3.0 | 3.0 | 3.0 | 3.0 | 3.0 | 3.0 | 2.5 | 2.0 | 1.5 | 1.0 | 1.0 | 0.8 | 0.7 | 0.5 |
| H | 50 | 5.0 | 5.0 | 5.0 | 5.0 | 3.0 | 3.0 | 3.0 | 3.0 | 5.0 | 5.0 | 3.0 | 3.0 | 3.0 | 3.0 | 2.5 | 2.0 | 1.5 | 1.0 | 1.0 | 0.8 | 0.7 | 0.5 |
| R | 100 | 5.0 | 5.0 | 5.0 | 5.0 | 3.0 | 3.0 | 3.0 | 3.0 | 5.0 | 5.0 | 5.0 | 5.0 | 3.0 | 3.0 | 2.5 | 2.0 | 1.5 | 1.0 | 1.0 | 0.8 | 0.7 | 0.5 |
| O | 150 | 5.0 | 5.0 | 5.0 | 5.0 | 3.0 | 3.0 | 3.0 | 3.0 | 3.0 | 4.0 | 5.0 | 5.0 | 5.0 | 3.0 | 2.5 | 2.0 | 1.5 | 1.0 | 1.0 | 0.8 | 0.7 | 0.5 |
| T | 151 | 3.0 | 3.0 | 3.0 | 2.8 | 0.6 | 0.6 | 0.6 | 0.6 | 0.6 | 0.6 | 0.6 | 0.6 | 0.6 | 0.6 | 0.6 | 0.6 | 0.6 | 0.6 | 0.6 | 0.6 | 0.6 | 0.5 |
| T | 200 | 0.5 | 0.5 | 0.5 | 0.5 | 0.5 | 0.5 | 0.1 | 0.5 | 0.5 | 0.5 | 0.5 | 0.5 | 0.5 | 0.5 | 0.5 | 0.5 | 0.6 | 0.6 | 0.6 | 0.6 | 0.6 | 0.5 |
| L | 300 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.6 | 0.6 | 0.6 | 0.6 | 0.6 | 0.5 |
| E | 400 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.6 | 0.6 | 0.6 | 0.6 | 0.6 | 0.5 |
| | 500 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.6 | 0.6 | 0.6 | 0.6 | 0.6 | 0.5 |
| P | 600 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.6 | 0.6 | 0.6 | 0.6 | 0.6 | 0.5 |
| O | 700 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.6 | 0.6 | 0.6 | 0.6 | 0.6 | 0.5 |
| S. | 800 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.6 | 0.6 | 0.6 | 0.6 | 0.6 | 0.5 |
| | 1000 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.6 | 0.6 | 0.6 | 0.6 | 0.6 | 0.5 |

FIG. 7

FIG. 8

| RPM | IGNITION ON TIME |
|---|---|
| 1000 | 5.0msec |
| 1500 | 5.0msec |
| 2000 | 3.5msec |
| 2500 | 2.5msec |
| 3000 | 2.0msec |
| 3500 | 1.5msec |
| 4000 | 1.0msec |
| 4500 | 1.0msec |
| 5000 | .8msec |
| 5500 | .7msec |
| 6000 | .6msec |

MULTIPLE SPARK CAPACITIVE DISCHARGE IGNITION SYSTEM FOR AN INTERNAL COMBUSTION ENGINE

CROSS-REFERENCE TO RELATED APPLICATIONS

This Application is a continuation of copending International Application Serial No. PCT/US97/10206, filed Jun. 19, 1997 claiming the benefit of U.S. Provisional Application Ser. No. 60/020,033, filed Jun. 21, 1996.

FIELD OF THE INVENTION

The invention relates to ignition systems for internal combustion engines, and particularly, to a multiple spark capacitive discharge ignition system for such an engine.

In internal combustion engines, it is known that the physical nature of the fuel or fuel/air charge injected into the cylinder varies depending upon engine operating conditions. Specifically, at low engine speeds, the fuel charge is injected into the cylinder in the form of a stratified cloud of fuel particles. The cloud of fuel particles is termed stratified because the density of the fuel particles within the cloud is not constant, i.e., not homogeneous throughout the charge. At higher engine speeds, the fuel charge is injected into the cylinder in what is termed to be a "homogeneous" cloud of fuel particles. The charge is termed homogeneous because the density of fuel particles in the fuel charge is relatively constant throughout the charge.

A single ignition spark or a small number of ignition sparks anywhere within a homogeneous fuel charge will cause complete combustion of the fuel charge. This is not so for a stratified fuel charge. With a stratified injection of fuel, it has been found desirable to provide a greater number of ignition sparks (than is provided under homogeneous conditions) in order to ensure that the stratified fuel charge is adequately or completely ignited. U.S. Pat. Nos. 5,170,760 and 4,653,459 generally illustrate ignition systems for providing a plurality of ignition sparks to ignite a stratified or non-homogeneous fuel charge in the cylinder.

SUMMARY OF THE INVENTION

The invention provides an ignition system for an internal combustion engine having one or more cylinders. The ignition system generates more ignition sparks per ignition event when the engine is operated in the stratified fuel injected mode than when the engine is operated in the homogeneous fuel injection mode. Generally speaking, the system includes an electronic control unit ("ECU") for generating ignition signals for the respective cylinders, an input/logic multiplexer for multiplexing the ECU control signals, a direct current to direct current ("DC—DC") converter for charging an ignition capacitor, a silicon controlled rectifier ("SCR") for discharging the ignition capacitor, an ignition trigger circuit for triggering the SCR and an ignition distribution network for distributing the energy discharged from the ignition capacitor to the appropriate ignition coil.

The DC—DC converter includes a pulse width modulator which generates, in response to the inputs from the ECU, a high frequency output of at least 1000 hertz frequency. Preferably, however, the frequency of the pulse width modulator output is 3.0 khz. The pulse width modulator drives a series of parallel connected high power insulated gate bipolar transistors ("IGBTs") connected through a transformer to a power supply. The power supply voltage is generated by the alternator. Energizing of the transistors by the pulse width modulator at a rate of approximately 3.0 khz causes a flyback voltage to be generated at the primary of the transformer. The flyback voltage is, through mutual inductance, transferred to the secondary of the transformer and "stepped-up" to approximately 200 to 300 volts. This voltage charges an ignition capacitor to approximately 200 to 300 volts. The ignition capacitor is selectively discharged by triggering the SCR to provide electrical energy to the ignition coil which generates a spark to ignite the fuel charge.

The current flowing through the IGBTs is monitored using a current sensing resistor connected in series with the IGBTs. The voltage across the current sensing resistor is "fed back" to the pulse width modulator. The pulse width modulator varies the width of the output pulses generated by the pulse width modulator to compensate for variations in the voltage of the power supply. Thus, as the voltage supplied by the alternator increases, the pulse width of the output of the pulse width modulator decreases. This allows the ignition system to operate effectively from a low voltage of approximately eight volts (which occurs upon engine cranking) to a high voltage of approximately 30 volts (which occurs during high speed engine operation). The use of current sensing to indirectly sense the variations of the supply voltage eliminates the need to compensate the ignition system for variations in the temperature of the system.

It is an advantage of the invention to provide a capacitive discharge ignition system that, in general, energizes the engine spark plug or spark plugs at a higher energy level or for a longer duration when the engine is operating under stratified fuel injection conditions than when the engine is operating under homogeneous engine operating conditions.

It is another advantage of the invention to provide an ignition system that increases the number of strike opportunities per ignition event when the fuel charge is stratified relative to when the fuel charge is homogeneous.

It is another advantage of the invention to provide the ignition sparks at a rate which at least exceeds 1000 hertz.

It is another advantage of the invention to provide an ignition system for an internal combustion engine that utilizes as its voltage source the voltage from the alternator.

It is another advantage of the invention to provide an ignition system for an internal combustion engine that utilizes a transformer which can accommodate larger voltage ranges.

It is another advantage of the invention to provide an ignition system for an internal combustion engine that charges the ignition capacitor using a flyback voltage.

It is another advantage of the invention to provide an ignition system which senses the current flowing through the transformer to eliminate the need for temperature compensation of the ignition system and improve the efficiency of the ignition system.

Other features and advantages of the invention are set forth in the following detailed description and claims.

BRIEF DESCRIPTION OF THE DRAWINGS

FIG. 7 is a chart which plots ignition coil on time as a function of engine speed and throttle position.

FIG. 8 is a chart which plots the maximum ignition coil on time for a given engine speed.

Figure 1:
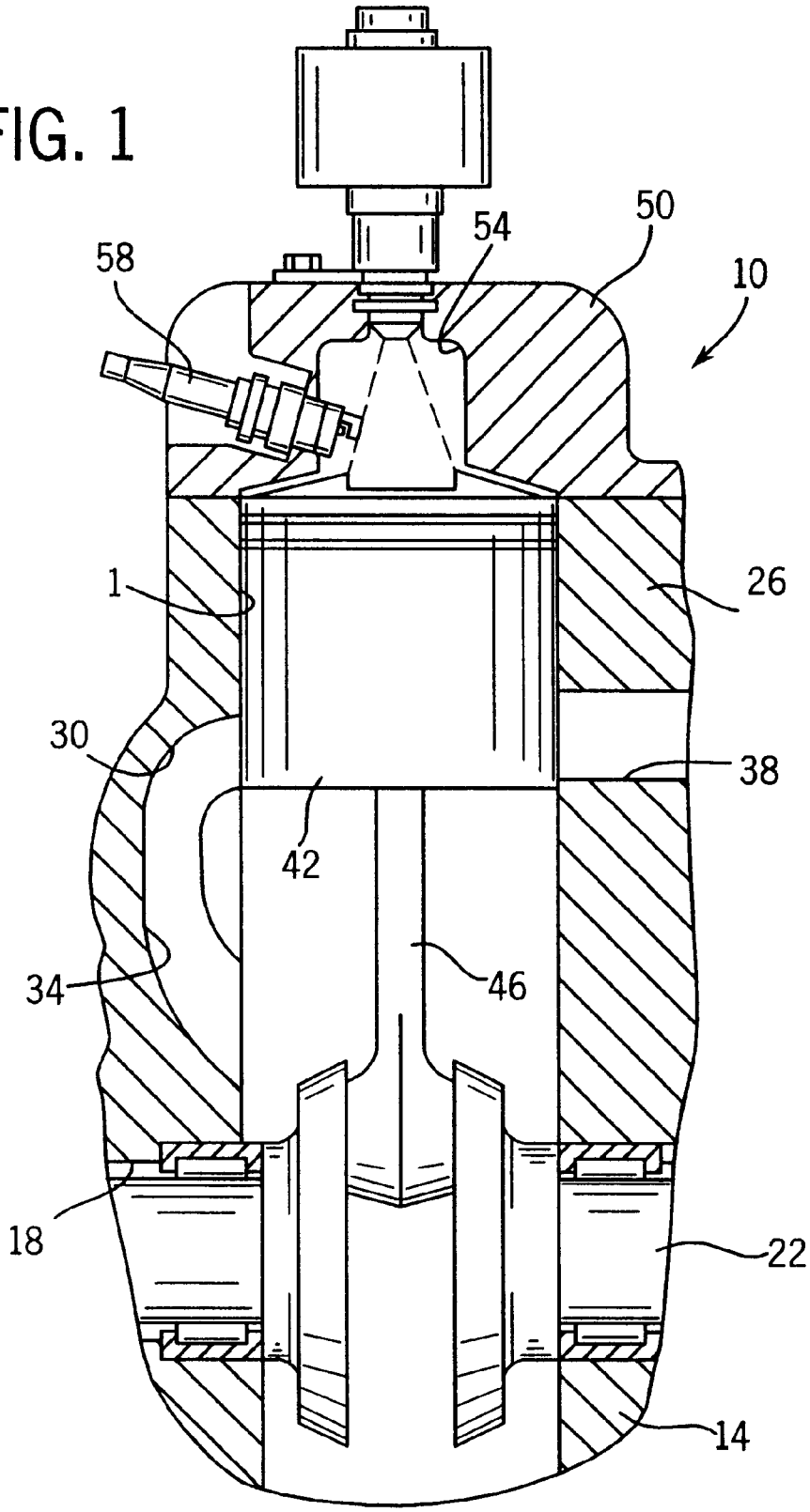
FIG. 1 is a partial cross section of an internal combustion engine embodying the engine.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

Partially shown in FIG. 1 of the drawings is an internal combustion engine 10 embodying the invention. Although any internal combustion engine is appropriate, the internal combustion engine of the preferred embodiment is a two-stroke, direct injected, internal combustion engine having six cylinders (illustrated schematically and labelled 1–6 in FIG. 6). Cylinder 1 of the engine is illustrated in detail in FIG. 1. The engine 10 includes a crankcase 14 defining a crankcase chamber 18 and having a crankshaft 22 rotatable therein. An engine block 26 defines the cylinder 1. The engine block 26 also defines an intake port 30 communicating between the cylinder 1 and the crankcase chamber 18 via a transfer passage 34. The engine block 26 also defines an exhaust port 38. A piston 42 is reciprocally movable in the cylinder 1 and is drivingly connected to the crankshaft 22 by a crank pin 46. The cylinder head 50 closes the upper end of the cylinder 1 so as to define a combustion chamber 54. A spark plug 58 is mounted on the cylinder head 50 and extends into the combustion chamber 54.

Figure 2:
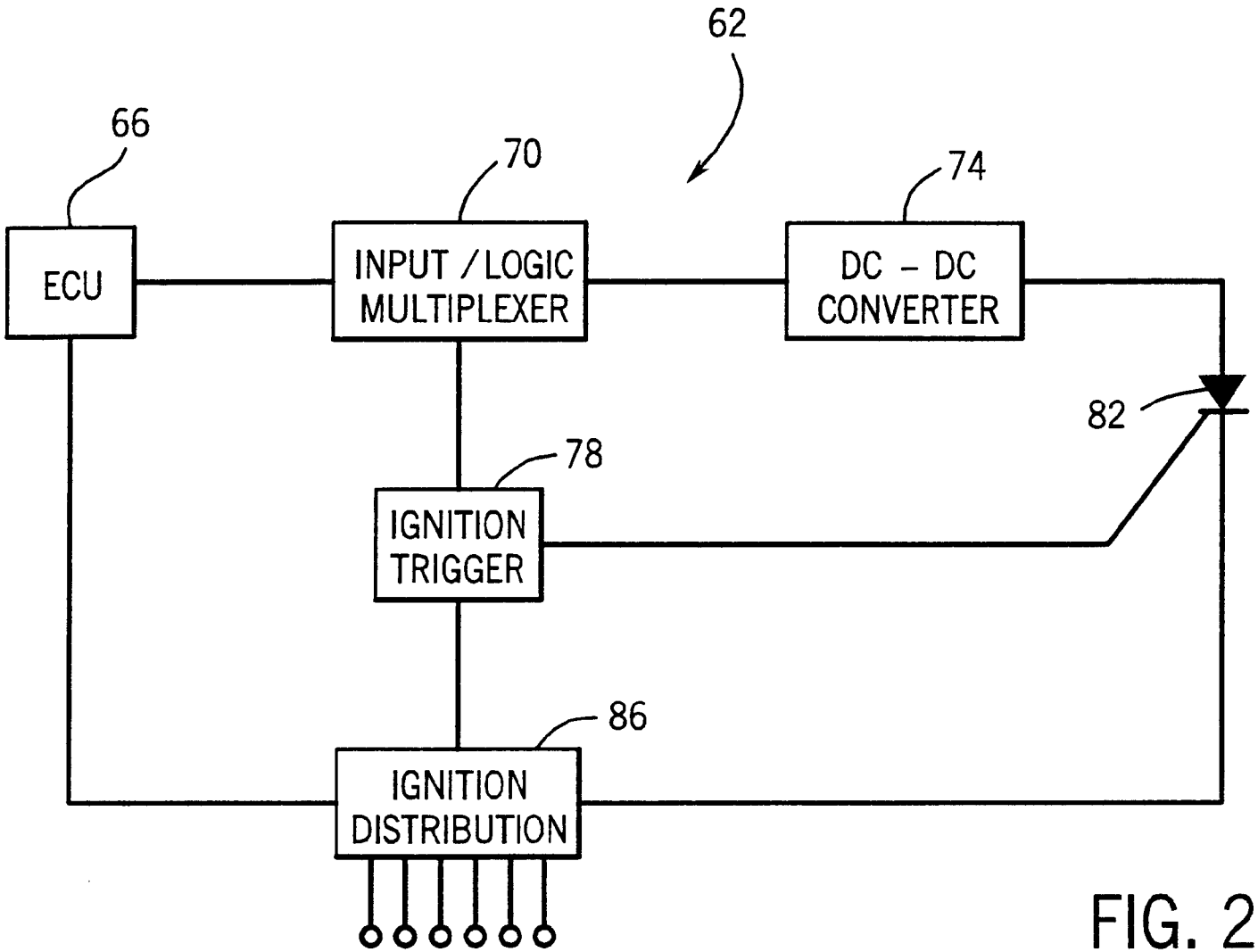
FIG. 2 is a block diagram of the ignition system for the internal combustion engine.

As shown schematically in FIG. 2 of the drawings, the internal combustion engine 10 also includes an ignition system 62 for providing an ignition spark to the spark plug 58 to ignite fuel in the cylinders 1–6. The ignition system 62 illustrated in FIG. 2 may be used in an internal combustion engine having any number of cylinders. In the preferred embodiment of the invention, the ignition system 62 generates a plurality of ignition sparks (per cylinder, per cycle) when the fuel charge injected into the cylinder is stratified, and generates fewer sparks (per cylinder, per cycle) when the fuel charge injected into the cylinder is homogeneous.

Figure 6:
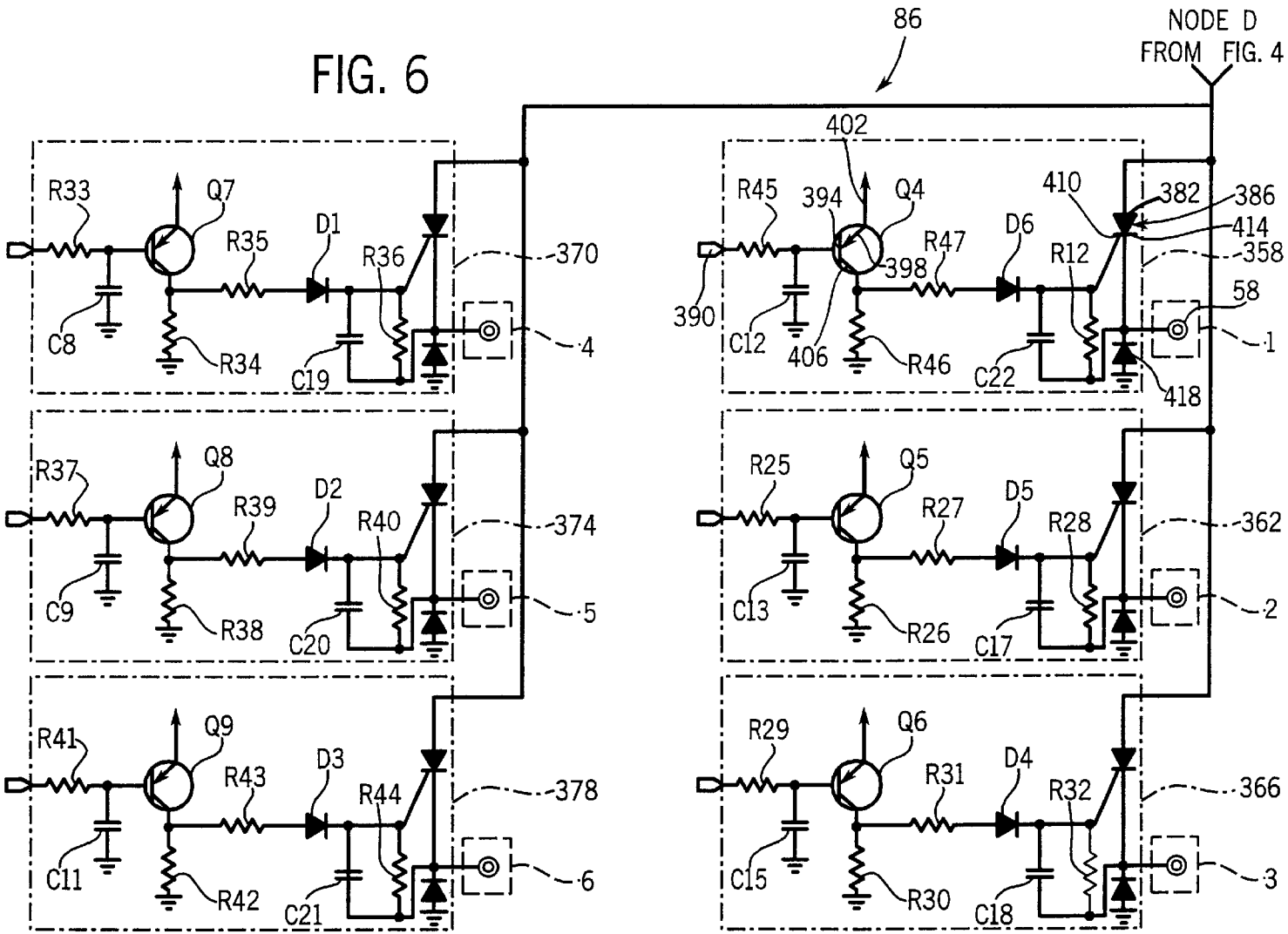
FIG. 6 is a detailed schematic of the ignition distribution circuit of ignition system.

In general terms, the ignition system 62 includes an electronic control unit ("ECU") 66, an input/logic multiplexer 70 (shown in detail in FIG. 3), a direct current to direct current ("DC—DC") converter 74 (shown in detail in FIG. 3), an ignition trigger circuit 78 (shown in detail in FIG. 4), a silicon controlled rectifier ("SCR") 82, and an ignition distribution circuit 86 (shown in detail in FIG. 6).

Any ECU for an internal combustion engine could be used to operate the ignition system 62. The ECU 66 generates an ignition control signal for each of the cylinders of the engine. In the embodiment of the engine shown in the drawings, the engine is a six cylinder engine and, accordingly, the ECU 66 generates six ignition control signals, i.e., one ignition control signal per engine cycle for each of the six cylinders.

Figure 3:
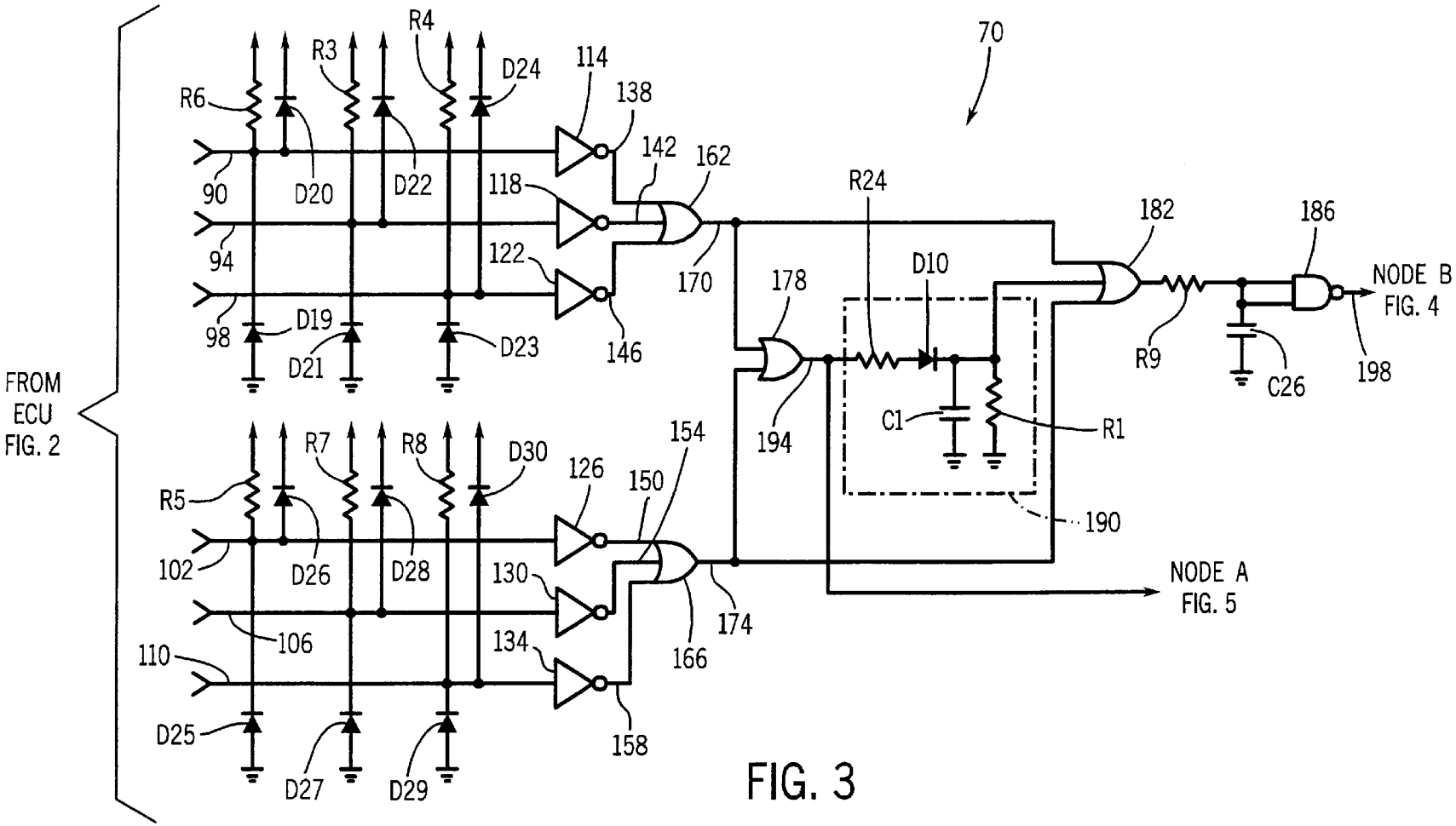
FIG. 3 is a detailed schematic of the input/logic multiplexer of the ignition system.

FIG. 3 illustrates the input/logic multiplexer 70 of the ignition system 62. As shown in FIG. 3, the ignition control signals from the ECU 66 (for cylinders one through six) are input to the input/logic multiplexer 70 on input lines 90, 94, 98, 102, 106, and 110. The input lines 90, 94, 98, 102, 106, and 110 are connected to inverters 114, 118, 122, 126, 130, and 134, respectively. The inverters 114, 118, 122, 126, 130, and 134 have outputs 138, 142, 146, 150, 154 and 158, respectively. The outputs 138, 142 and 146 are connected to OR gate 162 and the outputs 150, 154 and 158 are connected to OR gate 166. The outputs 170 and 174 of the OR gates 162 and 166, respectively, are connected to OR gate 178 and to OR gate 182. The input/logic multiplexer 70 also includes a delay circuit 190 connected to the output 194 of OR gate 178. The delay circuit 190 includes resistor R24, diode D10, capacitor C1 and resistor R1. The output of the delay circuit is connected to the input of OR gate 182 to completely combine or multiplex the ignition control signals from the ECU 66. The output of OR gate 182 is connected to NAND gate 186 through resistor R9. A capacitor C26 is connected to ground and to the inputs of NAND gate 186. Resistor R9 and capacitor C26 form a time delay circuit. The time delay created by R9 and C26 allows the capacitor C10 to completely discharge before receiving a subsequent energy pulse from the pulse width modulator 206. If the time delay were not provided, the subsequent energy pulse from the pulse width modulator 206 would reach SCR 82 during the discharge of energy from the capacitor C10. This would result in SCR 82 being "held open" by the signal from the pulse width modulator 206.

Figure 4:
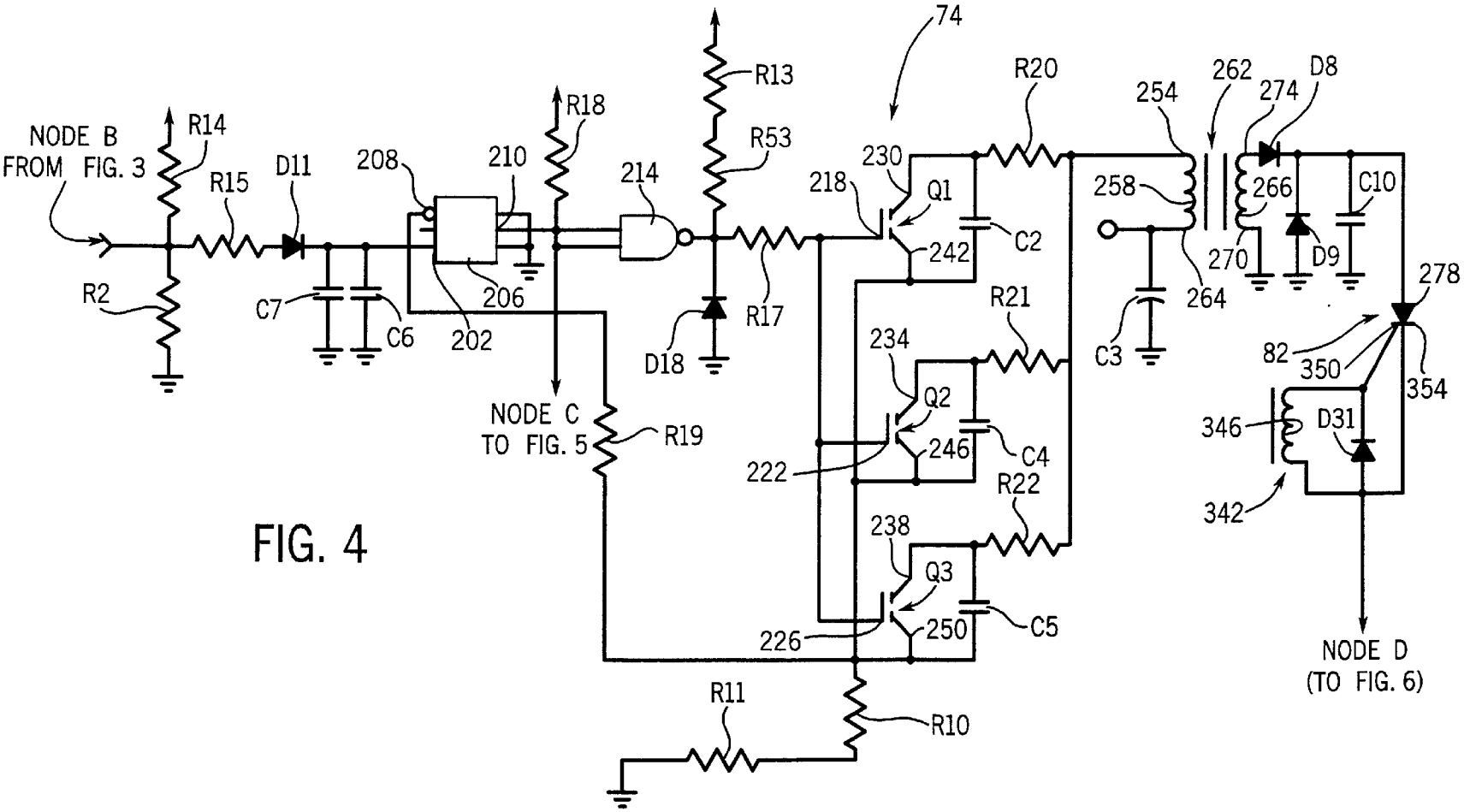
FIG. 4 is a detailed schematic of the DC—DC converter of the ignition system.

FIG. 4 illustrates the DC—DC converter 74 of the ignition system 62. The DC—DC converter 74 includes a pulse width modulator 206. The pulse width modulator 206 is a conventional component that is commercially available from a number of manufacturers. In the preferred embodiment, the pulse width modulator 206 is manufactured by National Semiconductor, Inc. and is marketed under part number LM2578. As shown in FIG. 4, the output 198 of NAND gate 186 is connected via node B to the oscillating input 202 (pin 3 of the LM2578 chip package) of pulse width modulator 206 through an RC circuit comprising resistors R2, R14 and R15, capacitors C6 and C7, and a diode D11. The pulse width modulator 206 also includes an inverted input 208 (pin 1 of the LM2578 chip package). In the preferred embodiment, pins 5 and 7 of the LM2578 chip package are connected to ground. The pulse width modulator 206 also has an output 210 (pin 6 of the LM2578 chip package) that is connected to a parallel connected bank of insulated gate bipolar transistors ("IGBTs") Q1, Q2 and Q3, through NAND gate 214, and through a resistive network including resistors R13, R53, R17 and diode D18.

As shown in the drawings, the IGBTs Q1, Q2 and Q3 include gates 218, 222, and 226, drains 230, 234 and 238, and sources 242, 246 and 250, respectively. The gates 218, 222 and 226 are connected (through the resistive network) to the output of the NAND gate 214, and the drains 230, 234 and 238 are connected through resistors R20, R21 and R22, respectively, to one end 254 of the primary winding 258 of a transformer 262. The sources 242, 246, and 250 are connected to ground via serially connected resistors R11 and R10, and are also connected to the inverted input 208 of pulse width modulator 206.

The opposite end 264 of the primary winding 258 is connected to a voltage source +V. In the preferred embodiment of the invention, the voltage source +v is the output of the internal combustion engine alternator (not shown). The transformer 262 also includes a secondary winding 266 connected at one end 270 to ground and at the opposite end 274 to diode D9 and ignition capacitor C10 through diode D8. The ignition capacitor C10 is connected to the anode 278 of the SCR 82. In the preferred embodiment, the transformer is a 1:2 step up transformer.

Figure 5:
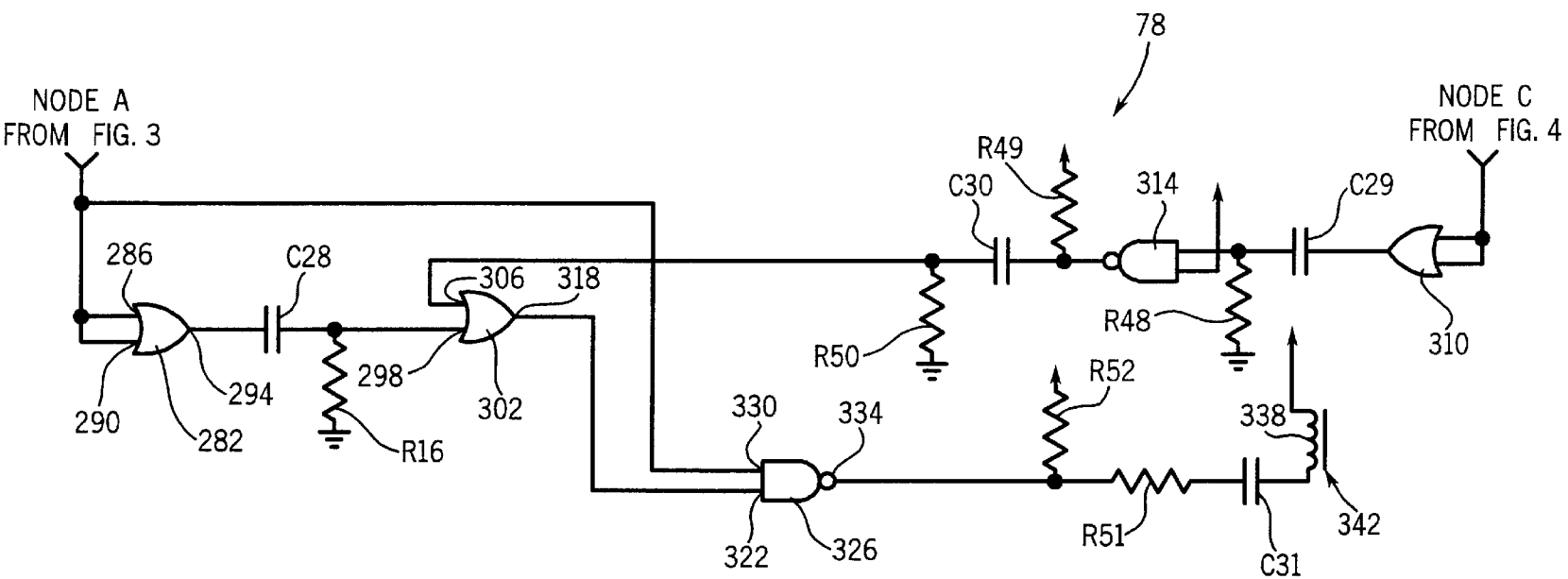
FIG. 5 is a detailed schematic of the ignition trigger circuit of the ignition system.

FIG. 5 illustrates the ignition trigger circuit 78 of the ignition system 62. The ignition trigger circuit 78 includes an OR gate 282 having inputs 286 and 290 connected to the output of OR gate 178 via node A. The output 294 of the OR gate 282 is connected through an RC circuit including capacitor C28 and resistor R16 to a first input 298 of OR gate 302. The second input 306 of the OR gate 302 is connected to the output 210 of the pulse with modulator 206 through OR gate 310, an RC circuit including capacitor C29 and resistor R48, NAND gate 314 and an RC circuit consisting of resistor R49, capacitor C30 and resistor R50. The output 318 of the OR gate 302 is connected to one input 322 of NAND gate 326. The other input 330 of NAND gate 326 is connected to the output of OR gate 178 from the input/logic multiplexer 70 via node A. The output 334 of the NAND gate 326 is connected through an RC circuit including resistors R52 and R51 and capacitor C31 to the primary winding 338 (FIG. 5 only) of isolation transformer 342 (shown in FIGS. 4 and 5). Secondary winding 346 (FIG. 4 only) of the isolation transformer 342 is connected in parallel to diode D31 and to the triggering gate 350 of the SCR 82. The cathode 354 of the SCR 82 is connected via node D to the ignition distribution circuit 86 of the ignition system 62.

Referring to FIG. 6, the ignition distribution circuit 86 includes ignition triggering modules 358, 362, 366, 370, 374 and 378, for each of the internal combustion engine cylinders 1, 2, 3, 4, 5 and 6, respectively. Each of the modules is identical and accordingly only the module 358 will be described in detail. The cathode 354 of SCR 82 is connected to the anode 382 of SCR 386. The input 390 to the module 358 is connected to the ECU 66 to receive the ECU ignition control signal for cylinder 1. The input 390 is connected to the base 394 of transistor Q4 through the RC circuit which includes resistor R45 and capacitor C12. The transistor Q4 includes an emitter 398 connected to a voltage supply 402 and a collector 406 connected to ground through resistor R46. The collector 406 is also connected to the gate 410 of the SCR 386 through the RC circuit including resistor R47, diode D6, capacitor C22 and resistor R12. The SCR 362 includes a cathode 414 that is connected to capacitor C22 and resistor R12 and to ignition coil 58 and diode 418 for the cylinder 1.

Though other components and arrangements of components are possible, the resistors and capacitors employed in the preferred embodiment have the following values.

R1—510 Kohm, ⅛/watt;

R2–R8, R14, R18, R24—1 Kohm, ⅛ watt;

R10, R11, R20–R22—0.01 ohm, 2 watt;

R12, R28, R32, R36, R40, R44—100 ohm, ⅛ watt;

R13, R53—47 ohm, ¼ watt;

R15, R17—24 ohm, ⅛ watt;

R16—82 Kohm, ⅛ watt;

R19, R26, R30, R34, R38, R42, R46—10 Kohm, ⅛ watt;

R25, R29, R33, R37, R41, R45—3.3 Kohm, ⅛ watt;

R27, R31, R35, R39, R43, R47—56 ohm, ⅛ watt;

R48—249 Kohm, ⅛ watt;

R49—5.1 Kohm, ⅛ watt;

R50—750 Kohm;

R51, R52—150 ohm, ⅛ watt;

C1, C28–C30—0.001 microfarad;

C2, C4, C5—100 picofarad;

C3—330 microfarad;

C6—4700 picofarad;

C7, C8, C9, C11–C13, C15—0.022 microfarad;

C10—0.68 microfarad;

C14, C17–C24, C31–C36—0.1 microfarad;

C16, C25—100 microfarad.

The selection of the particular gates, diodes, SCRs, transistors and other components (employed in the ignition system 62) is within the realm of one of ordinary skill in the art.

In operation, the inputs 90, 94, 98, 102, 106 and 110 are normally at a high voltage level (typically five volts and referred to variously as "high" or "logical '1'"). In order to generate an ignition control signal at a particular input 90, 94, 98, 102, 106 or 110, the ECU 66 "pulls" the input to a low voltage level (typically zero volts and referred to variously as "low" or "logical '0'"). The inputs 90, 94, 98, 102, 106 and 110 are inverted by inverters, respectively, and the ouputs of the inverters are "combined" or multiplexed by OR gates 162, 166, 178 and 182 and are buffered by NAND gate 186 for inputting to the DC—DC converter 74. The output of the OR gate 178 is also input to the ignition trigger circuit 78 and to OR gate 182 through delay circuit 190. The delay circuit 190 creates a time delay that allows the pulse width modulator 206 to continue to run even after the ignition control signal attributable to the previous cycle returns to the high condition. This assures that the ignition capacitor C10 remains charged for the beginning of the current cycle, i.e., when the next ignition control signal from the ECU 66 "goes low".

In response to the output of the input/logic multiplexer 70 (from NAND gate 186) the pulse width modulator 206 generates, on output 210, an oscillating signal having a frequency of approximately between 1000 hertz and 4500 hertz, but which frequency is preferably approximately 3000 hertz (hz). The oscillating signal drives transistors Q1, Q2, and Q3 at the 3000 hz frequency causing current from the alternator to flow through the primary winding 258 of the transformer 262.

The rapid switching of the current through the transformer 262 generates a flyback voltage that is multiplied and transmitted, through mutual inductance of the transformer 262, to the secondary winding 266 of the transformer 262. The voltage appearing at the secondary winding 266 is approximately 200 to 300 volts. This voltage is stored momentarily by the ignition capacitor C10 until the ignition capacitor C10 is discharged by triggering of SCR 82.

The current flow through the primary winding 258 of transformer 262 is monitored by placing current sensing resistors R10 and R11 in the current flow path and inputting the voltage across the resistors R10 and R11 to the inverted input 208 of pulse width modulator 206. The pulse width of the pulse width modulator output 210 is changed or modulated in response to this voltage so that the ignition system 62 is effective through a wide range of alternator voltages, i.e., in the preferred embodiment, the alternator voltage range (through which the ignition circuit 62 is effective) is approximately 8 volts to approximately 30 volts. In effect, at low alternator voltages, the pulse width of the output 210 of the pulse width modulator 206 is increased to assure sufficient charge voltage for the ignition capacitor. As the alternator voltage rises, the pulse width of the output 210 of the pulse width modulator 206 decreases. At the beginning of a cycle, the initial trigger for the SCR 82 is generated by the ignition trigger circuit 78 because there is no output 210 from the pulse width modulator 206 to trigger (via trigger circuit 78) the SCR 82. After the initial triggering event, the pulse width modulator output 210, which is connected to the SCR 82 through the ignition trigger circuit 78, is used to trigger the discharge of the ignition capacitor C10.

The ignition control signals from the ECU 66 are input to the appropriate ignition distribution modules of the ignition distribution circuit 86. When a particular ignition control signal is generated by the ECU 66, the ignition control signal triggers the SCR of the respective ignition distribution module and that SCR is "held" open until the ignition control signal is turned off by the ECU 66. As long as the ignition distribution module SCR is held open, the energy discharged from the ignition capacitor C10 is transmitted directly to the ignition coil and spark plug connected to that ignition distribution module.

The ignition system is capable of generating a varying number of ignition sparks at the spark plug to increase or decrease the total spark duration according to various engine operating conditions such as engine speed, engine load, throttle position etc. Though various combinations of desired total spark duration as a function of engine operating conditions are appropriate depending upon the circumstances, the desired total spark duration of the preferred embodiment is determined as a function of both the engine speed and the throttle position as set forth in the chart shown in FIG. 7. Moreover, while the invention has been described in terms of generating a higher number of sparks under stratified engine operating conditions, the higher energy level could also be provided under stratified engine operating conditions in the form of a longer spark duration or a higher spark voltage or a combination of longer spark duration, higher spark voltage and higher number of sparks.

As shown in FIG. 7, on the "Y" axis of the chart, the numbers zero through one thousand represent relative throttle positions, zero representing the idle position of the throttle, and one thousand representing wide open throttle. The numbers along the "X" axis represent the speed of the engine as measured in crankshaft rotations per minute. The numbers in the body of the chart represent ignition spark on time measured in milliseconds.

Generally, the chart shows a trend toward decreasing the total spark duration (ignition coil on time) with increasing engine speed and with increasing throttle position. Based on the ignition coil on times shown in the chart, the highest number of sparks attained, with the pulse width modulator 206 operating at approximately 3000 hertz, is approximately fifteen (at 5.0 ms of ignition coil on time, e.g., at idle throttle position and 200 rpm), and the lowest number of sparks attained is one (at 0.1 ms of ignition coil on time, e.g., at 500 throttle position and 1100 rpm). At wide open throttle and 7000 rpm, two ignition sparks are generated (0.5 ms of ignition coil on time).

Though, as stated above, there is a general trend toward decreasing the ignition coil on time with increasing speed and increasing throttle position, the ignition coil on time does not decrease continuously with increasing speed and increasing throttle position. Rather, there exist some discontinuities in the general trend toward decreasing ignition coil on time with increasing engine speed and increasing throttle position. These discontinuities exist as a result of empirical evidence that the precise ignition coil on times shown in the chart result in improved engine performance.

FIG. 8 is a chart illustrating the maximum ignition coil on time allowed. Exceeding these on times will result in overlap of the ignition event between cylinders.

Various features and advantages of the invention are set forth in the following claims.

What is claimed is:

1. An ignition circuit for an internal combustion engine, comprising:

a transformer having a primary winding connected to a voltage source and a secondary winding;

a capacitive discharge ignition circuit, having a single ignition capacitor device coupled to the transformer secondary winding; and an electronic circuit for repetitively generating a flyback voltage on the primary winding of the transformer that is coupled to the secondary winding for charging the single ignition capacitor device, wherein the ignition circuit is operable to produce a plurality of ignition sparks in a spark plug each combustion cycle from the single ignition capacitor device in order to ignite the fuel charge in a cylinder, the electronic circuit being adapted to generate a greater number of sparks during each combustion cycle when a fuel charge in the cylinder is stratified than when the fuel charge in the cylinder is homogeneous.

2. The ignition circuit as recited in claim 1, wherein the single ignition capacitor device is a single capacitor.

3. The ignition circuit as recited in claim 1, wherein the ignition circuit generates a plurality of sparks in each cylinder each combustion cycle from the single ignition capacitor device when a fuel charge injected into the cylinder is stratified.

4. An internal combustion engine comprising:

a plurality of cylinders;

a spark plug in each cylinder of the engine, to produce ignition sparks in each cylinder;

a voltage source; and an ignition circuit electrically coupled to the voltage source and to each spark plug, wherein the ignition circuit is operable to produce a plurality of ignition sparks in each spark plug each combustion cycle from the single ignition capacitor device, comprising:

an electronic control unit for generating ignition control signals;

a pulse width modulator that produces output pulses of varying pulse width in response to ignition control signals;

an electronic switch;

a transformer having a primary winding and a secondary winding; the primary winding being electrically coupled to the pulse width modulator and the electronic switch for generating a flyback voltage in the primary winding that is coupled to the secondary winding.

5. An internal combustion engine comprising:

an engine block defining at least one cylinder for receiving a fuel charge therein;

a spark plug mounted in the engine block and communicating with the at least one cylinder;

a voltage source;

an ignition circuit electrically coupled to each spark plug, wherein the ignition circuit is operable to produce a plurality of ignition sparks in each spark plug each combustion cycle, the ignition circuit being adapted to generate a greater number of sparks during each combustion cycle when a fuel charge in the cylinder is stratified than when the fuel charge in the cylinder is homogeneous, the ignition circuit comprising:

an electronic unit for generating ignition control signals;

a pulse width modulator electrically coupled to the electronic control unit, wherein the pulse width modulator produces an oscillating output in response to the ignition control signals;

a transformer;

a ignition capacitor device;

means for electrically coupling the transformer to the voltage source and to the pulse width modulator to generate a flyback voltage to charge the ignition capacitor device; and means for electrically coupling the ignition capacitor device to each of the spark plugs.

6. The internal combustion engine as recited in claim 5, wherein the means for electrically coupling the transformer to the voltage source and to the pulse width modulator to generate a flyback voltage to charge the ignition capacitor includes a bank of insulated gate bipolar transistors electrically connected in parallel, each transistor having a gate, a drain and a source.

7. The internal combustion engine as recited in claim 6, wherein each gate is electrically coupled to the pulsed output of the pulse width modulator, each drain is electrically coupled to the primary winding of the transformer, and each source is electrically coupled to ground and to the input of the pulse width modulator.

8. The internal combustion engine as recited in claim 5, wherein the means for electrically coupling the single ignition capacitor device to each of the spark plugs includes an ignition trigger circuit that selectively operates in response to an ignition control signal to enable a discharge path for the single ignition capacitor device.

9. The internal combustion engine as recited in claim 8, wherein the discharge path for the ignition capacitor includes a silicon controlled rectifier that is operated in response to ignition control signals.

* * * * *